US005954493A

United States Patent [19]

Rajewski

[11] Patent Number: 5,954,493

[45] Date of Patent: Sep. 21, 1999

[54] NOZZLE AND PILOT FOR THE BURNING OF GAS

[76] Inventor: Robert Carl Rajewski, R.R. #1, Donalda, Alberta, Canada, T0B 1H0

[21] Appl. No.: 08/837,492

[22] Filed: Apr. 18, 1997

Related U.S. Application Data

[62] Division of application No. 08/262,617, Jun. 20, 1994, Pat. No. 5,634,788.

[30] Foreign Application Priority Data

Jun. 10, 1994 [CA] Canada ..... 2125634

[51] Int. Cl.[6] ..... F23D 23/00

[52] U.S. Cl. ..... 431/202; 431/266; 431/278

[58] Field of Search ..... 431/202, 266, 431/278, 264, 354

[56] References Cited

U.S. PATENT DOCUMENTS

| | | | |
|---|---|---|---|
| 4,406,615 | 9/1983 | Guerra et al. | 431/202 |
| 4,826,427 | 5/1989 | Hyde | 431/202 |
| 5,429,496 | 7/1995 | Stephens et al. | 431/202 |

*Primary Examiner*—Carl D. Price
*Attorney, Agent, or Firm*—Davis and Bujold

[57] ABSTRACT

A nozzle for a pilot light for a flare stack, the nozzle being formed of a housing defined by an encircling cylindrical wall, with radially extending openings formed circumferentially around the encircling wall, and is made of material resistant against breakdown in a sour gas environment at temperatures at least less than 1200° C., preferably 98% by weight alumina ceramic. A cage holds the nozzle, which includes a base plate having a central aperture and first and second sides, a tube extending into the aperture from the first side of the base plate and fixed to the base plate, and plural retainers extending from the base plate and enclosing the nozzle. To form a pilot for a flare stack, a gas conduit is connected into an interior cavity of the nozzle. The cage is attached to a flame stack. Spaced electrodes form a spark gap adjacent one of the openings in the nozzle. A source of electrical power is connected to one of the first and second electrodes. One electrode extends in a ring, while the other extends in a plane. The cage is preferably grounded, with one electrode connected to the cage, and the second electrode is spaced from the cage and free to move in ambient wind conditions.

6 Claims, 9 Drawing Sheets

NOZZLE AND PILOT FOR THE BURNING OF GAS

This is a divisional of application Ser. No. 08/262,617 filed on Jun. 20, 1994 now U.S. Pat. No. 5,634,788.

FIELD OF THE INVENTION

This invention relates to nozzles and pilots used in the burning of gas.

BACKGROUND AND SUMMARY OF THE INVENTION

So far as known to the inventor, previous pilots made by others have been formed of metal and had open ended nozzles. These nozzles tended to melt and were subject to peening in the highly corrosive environment of a natural gas flare.

In one particular pilot of the prior art, there is provided a flame front generator. Fuel and air is pre-mixed and supplied to one end of a pipe, the other end of which includes a nozzle placed adjacent the top of a flare stack. The fuel-air mixture is ignited and travels along the pipe to the nozzle. Such an arrangement is troublesome in that if the pilot goes out, all the fuel-air mixture in the pipe must be blown out before the pilot can be re-lit. The resulting delay and difficulties in establishing the precise fuel-air mixture required to create the flame front (which is dependent on the humidity) makes this pilot unreliable.

The present invention is intended to provide an improvement in pilots for flare stacks, and in particular is intended to provide a continuous pilot that may be re-lit instantaneously.

There is therefore provided in accordance with an aspect of the invention a pilot for a flare stack. The pilot nozzle, an igniter and a frame assembly for operably supporting the igniter, nozzle and conduit means on the flare stack. The conduit means comprises a conduit having first and second ends, the nozzle being secured to the first end of the conduit. A venturi tube is also secured to the first end of the conduit. A gas supply line is encased within the conduit and secured at the first end of the conduit by a tubing fitting. A nipple is secured to the tubing fitting and terminates at one end of the venturi tube.

BRIEF DESCRIPTION OF THE DRAWINGS

There will now be described preferred embodiments of the invention, with reference to the drawings, by way of illustration, in which like numerals denote like elements, and in which.

DETAILED DESCRIPTION OF PREFERRED EMBODIMENTS

Figure 1:
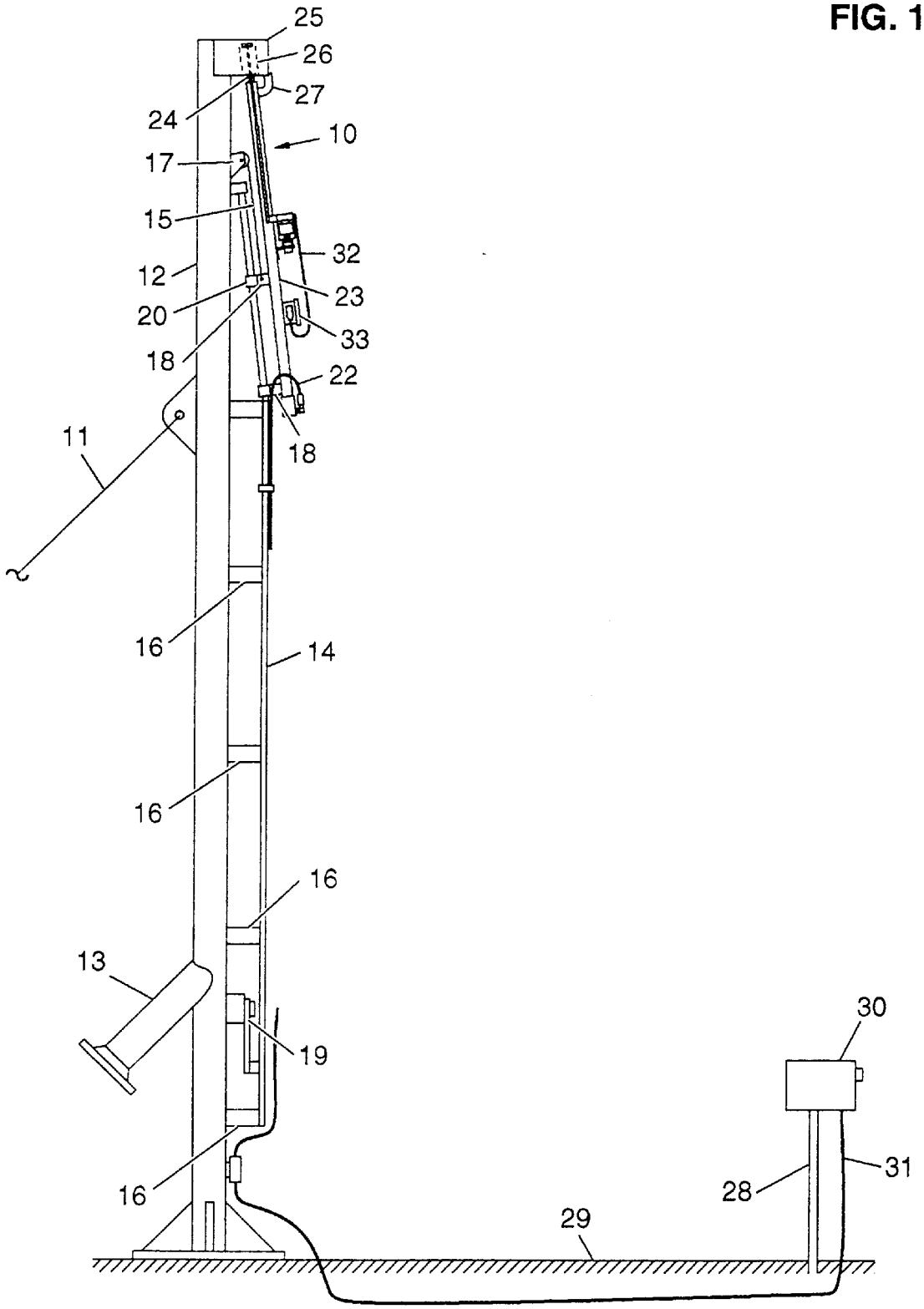
FIG. 1 shows a schematic of a flare stack supporting a pilot and nozzle according to the invention for use with shorter stacks.

Referring to FIG. 1, there is shown a pilot generally shown at 10 for a flare stack 12 such as is used to flare gas at an oil well. The flare stack 12 is supported by guy wires 11 in conventional fashion and has a gas supply inlet 13 mounted at 45°. A rail 14 (2"×1" HSS) running parallel to and spaced from the flare stack 12 is supported on supports 16 (¼"×3"×6"), with a portion of the rail near the top tilted towards the flare stack 12. The pilot 10 has supports 18 terminating in sleeves 20 that slide on the rail 14. The pilot 10 is pulled up and down the stack on the rails 14 using cable 15, enclosed pulley 17 and winch 19.

Pilot 10 includes a high pressure flexible gas supply line 22 connected to a high pressure source of gas (not shown) and that terminates in a nozzle 24 held in a frame or cage 26. The gas supply line 22 is supported within the pilot by conduit 23 attached to supports 18. Conduit 23, supports 18, sleeves 20, rail 14 and supports 16 together form means for attaching the cage 26 and nozzle 24 to flare stack 12. The pilot 10 is moved into a shroud 25, guided by guide 27, at the top of the flare stack and a flame is kept burning constantly in the nozzle 24 so that should for any reason the gas being flared through the flare stack stop burning, then the gas will be immediately ignited.

Also shown in FIG. 1 is a general arrangement for an ignition system for a flare stack that is 90' high or shorter. Mounting pole 28 made of 2" pipe is secured to the ground 29 at a minimum 40' from the flare stack. Control and battery power source enclosure 30, which is of conventional construction, is mounted on the pole 28. A hot ignition wire 31 (#16-3 Teck™ cable) extends from the control enclosure 30 to and along the flare stack to ignition rod 32 (¼"316 SS) which is connected to the pilot by a transformer and electrical junction enclosure 33. Further detail of the ignition system may be found in the inventor's U.S. Pat. No. 5,291,367, but the ignition system itself may be any of various embodiments known in the art.

Figure 2:
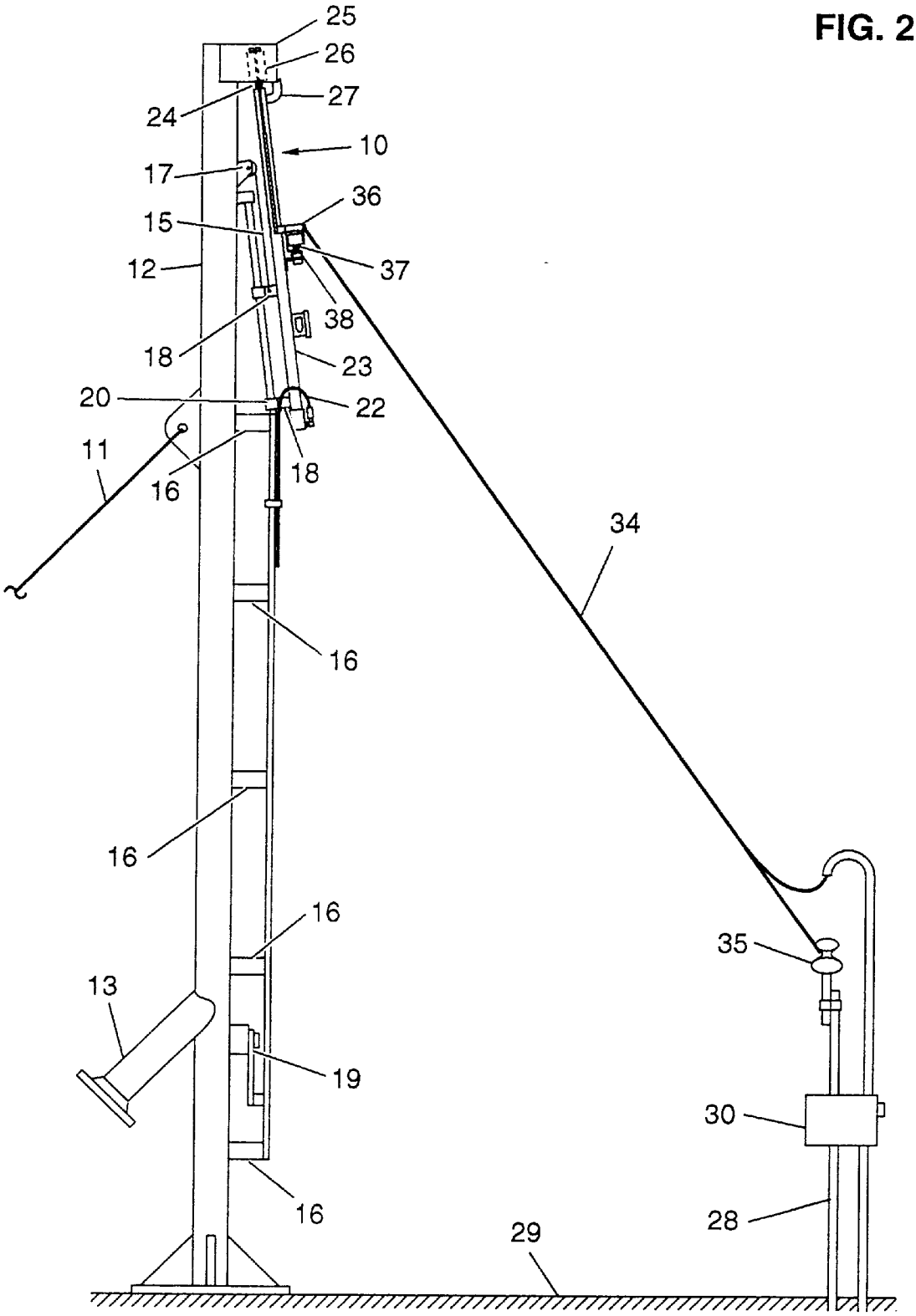
FIG. 2 shows a schematic of a flare stack supporting a pilot and nozzle according to the invention for use with longer stacks.
Figure 3:
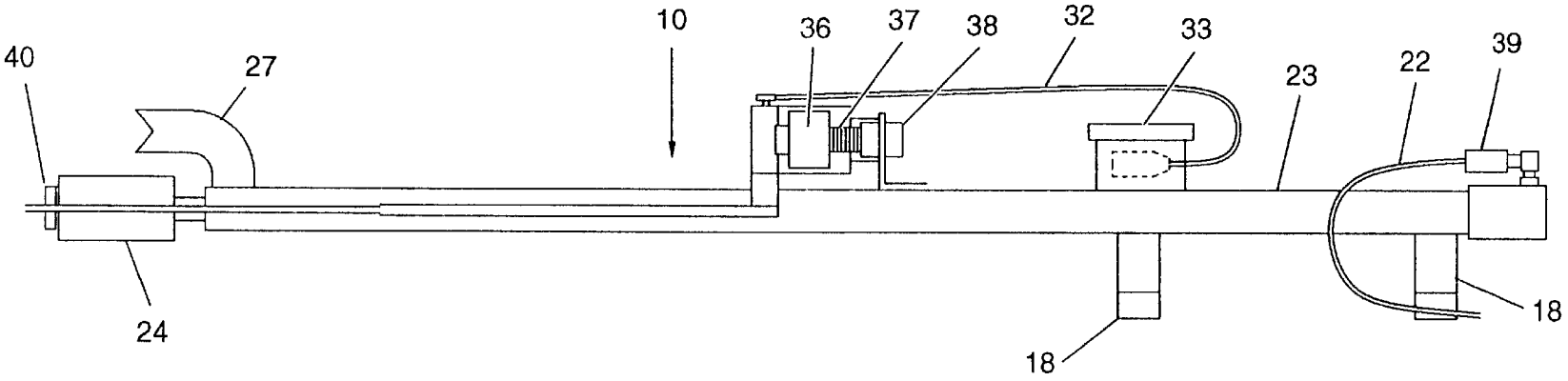
FIG. 3 is a side view schematic of a pilot according to the invention.
Figure 4:
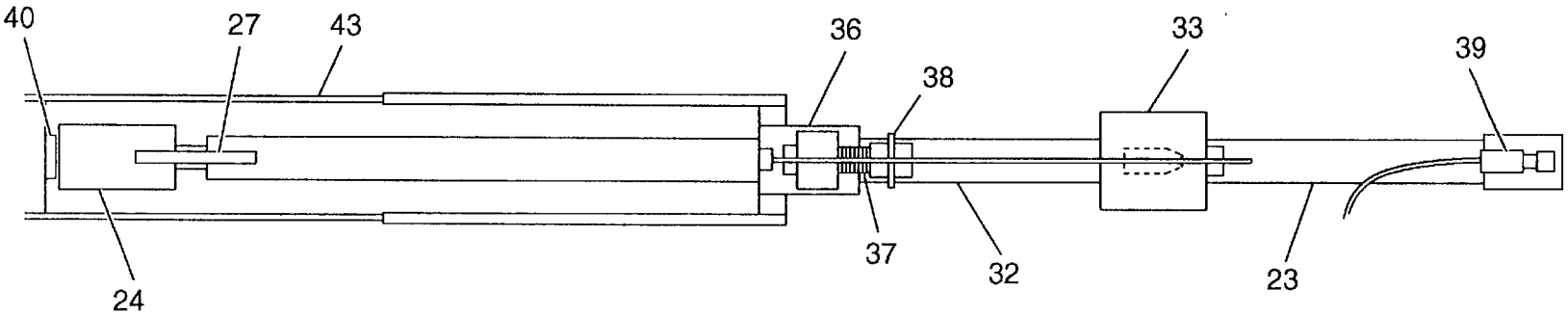
FIG. 4 is a top view schematic of the pilot of FIG. 3.
Figure 5:
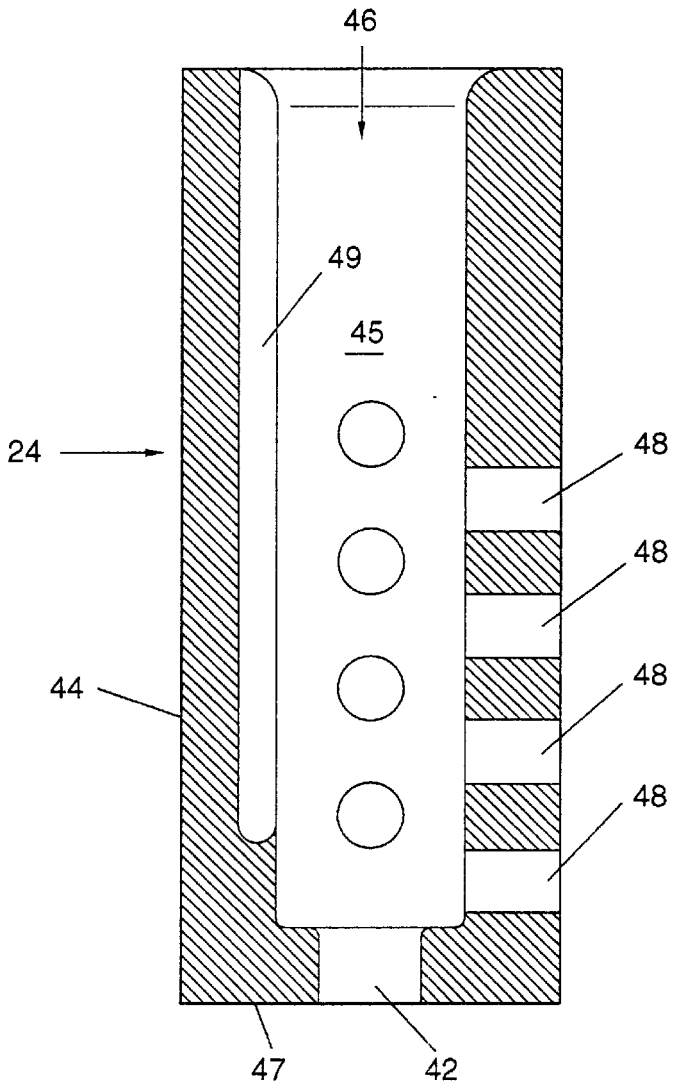
FIG. 5 is a cross-section of a nozzle according to the invention for use in particular in association with the pilot of FIGS. 3 and 4.
Figure 6:
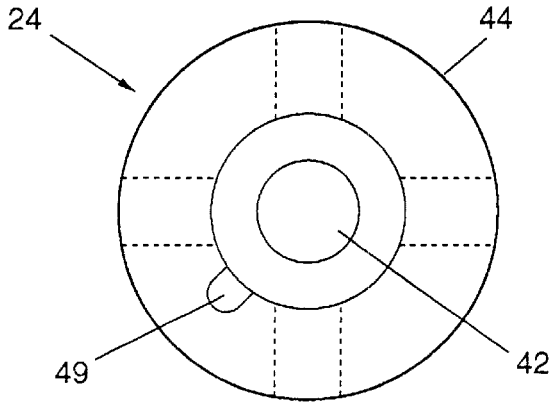
FIG. 6 is a top view of the nozzle of FIG. 5.

For flare stacks that are 90' and higher, the embodiment of FIG. 2 should be used, in which the same features are included except that high voltage cable (⅛" dia steel cable) 34 runs out from insulator and mount 35 on enclosure 30 to an alumina ceramic insulator and stainless steel housing 36 forming part of the pilot 10. The housing 36 is mounted on an insulator 37 with mounting bracket 38 bolted to the conduit 23.

A preferred pilot 10 and nozzle 24 is shown particularly in FIGS. 3–9. Gas supply line 22 supplies gas to the inside of the conduit 22 through fuel filter 39. The gas supply line 22 extends through the conduit 23 to nozzle 24. Fuel and air mixture in the nozzle 24 is ignited by electrodes 40 and 41 (FIGS. 8 and 9 in particular) disposed adjacent an opening 42 in the end of the nozzle 24 opposed to the end into which the gas supply line 22 supplies fuel. Electrode 40 is the hot electrode and forms part, the tip end, of probe 43 (½"316 SS). Probe 43 extends from and is supported by housing 36 and extends around the nozzle 24 to the open end 42 of the nozzle 24. By virtue of this arrangement, the electrode 40 is free to move in ambient wind conditions in a plane (actually part of a sphere whose diameter is the length of the probe).

Figure 7:
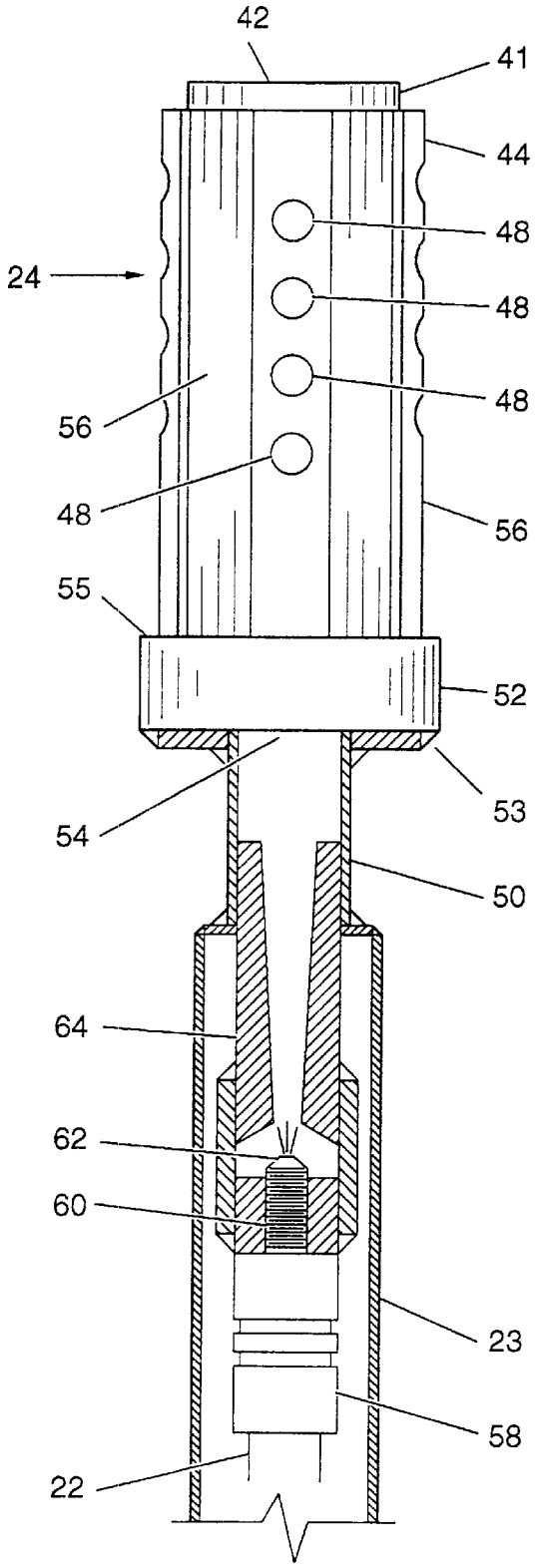
FIG. 7 is a detailed schematic showing the internal workings of the pilot of FIGS. 3 and 4.
Figure 8:
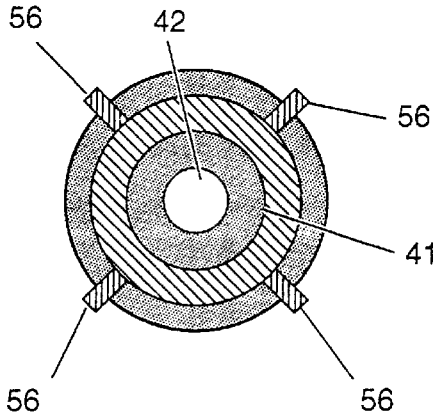
FIG. 8 is a top view of a ceramic nozzle and frame assembly according to the invention.
Figure 9:
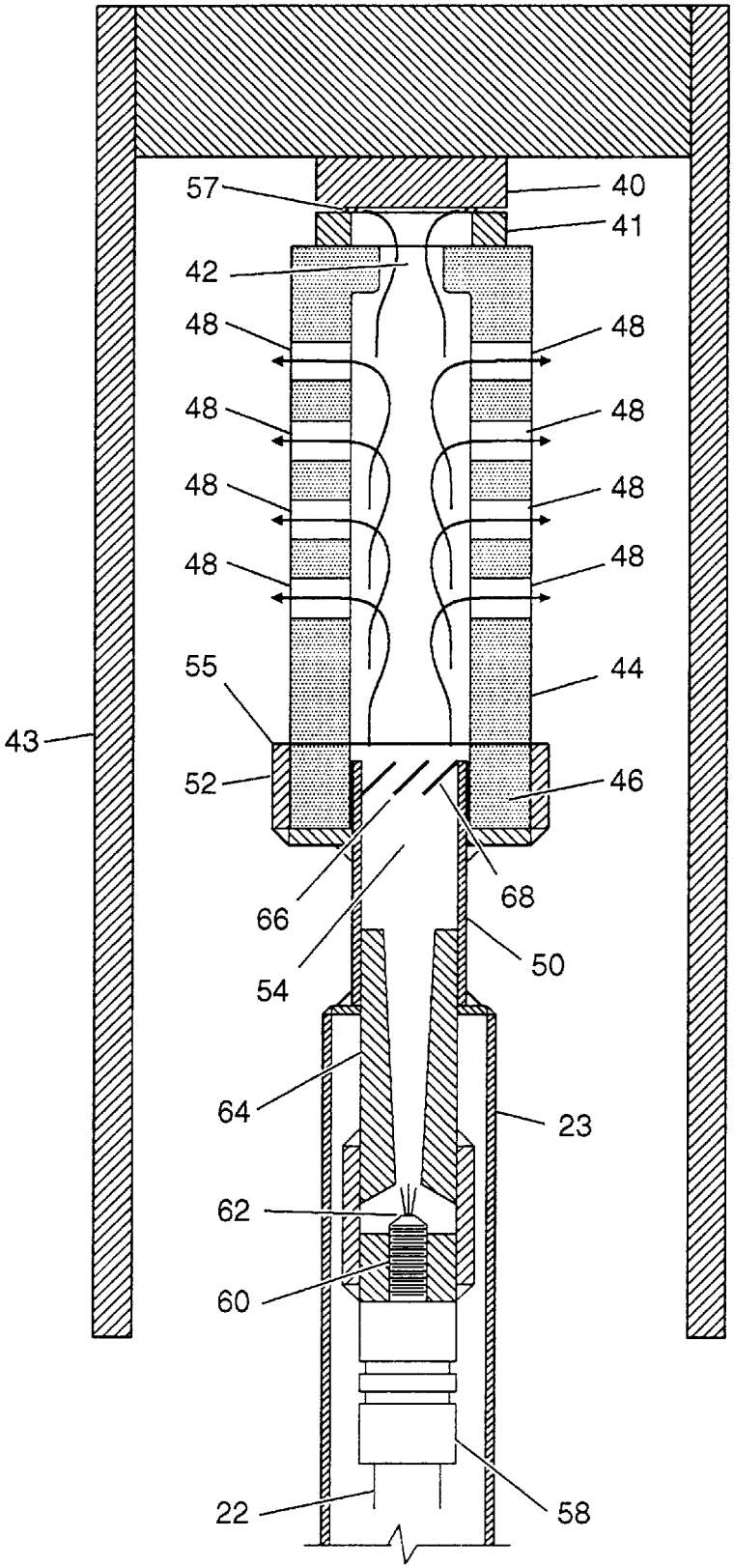
FIG. 9 is a cross-section of a nozzle and igniter according to the invention.

The nozzle 24 is made of electrically non-conducting material characterized by being resistant against breakdown in a sour gas environment at temperatures at least lower than 1200° C., and preferably over a temperature range up to over 3000° C. The nozzle 24 shown is 98% by weight high alumina ceramic available from Coors Ceramic of Boulder, Colorado, USA. Such a material is resistant against breakdown up to about 3600° C. Another useful material for the nozzle is believed to be silica carbide. Like ceramics are believed to work as well. The nozzle 24 is formed from a housing having an encircling wall 44 defining an interior cavity or bore 45 and is preferably cylindrical. One end 46 of the nozzle is open for the flow of gas into the nozzle, and the other end has opening 42 whose diameter (hence areal extent) is smaller than the diameter (hence areal extent) of the bore 45. In other words, the opening 42 is constricted in relation to the bore 45 of the nozzle 24 by end wall 47. The encircling wall 44 and end wall 47 are each ¾" thick. The nozzle 24 shown here is 7.28" long. A plurality (16 in the instant case) of openings 48 are formed circumferentially around the encircling wall 44 and extend radially through the encircling wall 44. As shown in FIGS. 7 and 9 in particular, the gas supply line 22 supplies gas into the interior cavity 45 of the nozzle 24 through a tube 50 forming part of cage 26 confining the nozzle 24. The tube 50 and gas line 22 together form a gas supply conduit leading into the interior cavity 45 of the nozzle 24. A slot 49 for a thermocouple is also provided in the nozzle.

The cage 26 enclosing the nozzle 24 is preferably formed from a circular base plate 52 having a central aperture 54. The tube 50 extends into the aperture 54 from side 56 of the base plate 52 and is fixed to the base plate 52 as by welding. Four retainers 56 extend from side 55 of base plate 52 and enclose the nozzle 24. Three or more retainers 56 may be used distributed around and extending from the base plate 52 in like manner. A linear electrode 41 encircles the opening 42 and is secured in place as by welding to the retainers 56. The retainers 56 and electrode 41 together constitute a probe, the electrode 41 forming a tip end of the probe. Electrode 40 forming part of probes 43 is spaced from electrode 41 to form a spark gap 57. Electrode 40 extends in two dimensions to form a circular plate, whose edges more or less correspond to the edges of the ring electrode 41. Electrode 41 is preferably grounded, and attached to the cage 26 as shown, which itself is electrically connected to the conduit 23 through base plate 52, so that the majority of the components of the pilot are grounded. The electrode 40 is preferably hot and connected to a source of electrical power such as ignition system 46, several of which are known in the art, as for example the one described in U.S. Pat. No. 5,291,367 on Mar. 1, 1994. Since the frame 26 is preferably stainless steel and connected to the supporting structure (elements 12, 14, 16, 18 and 20 etc) for the pilot, the hot electrode 40 cannot touch the cage assembly 26 and therefore extends about the nozzle 26. The hot and grounded electrodes could conceivably be reversed, with appropriate insulators for the hot electrode, but it is preferable that the hot electrode be on the outside.

Referring to FIGS. 7 and 9, the manner of gas delivery to the nozzle 24 is shown. A supply line 22 is encased within the conduit 23. The supply line 22 leads out to a source of natural gas in conventional manner. The gas supply line 22 is secured within the conduit 23 by a conventional high pressure tubing fitting 58 braced across the end of the conduit 23. A nipple 60 is threaded into the tubing fitting 58, with the tip 62 of the nipple 60 terminating at one end of a venturi tube 64. The tube 50 of the cage 26 is fastened, as by welding, to the conduit 23, with venturi tube 64 secured within the tube 50. The other end of the tube 38 includes a mixer or flame stabilizer 66 formed of three pie-shaped cups 68 which are angled, as in the flights of a spiral, to impart a rotational movement to fluid moving from the tube 50 into the nozzle 24.

Figure 14:
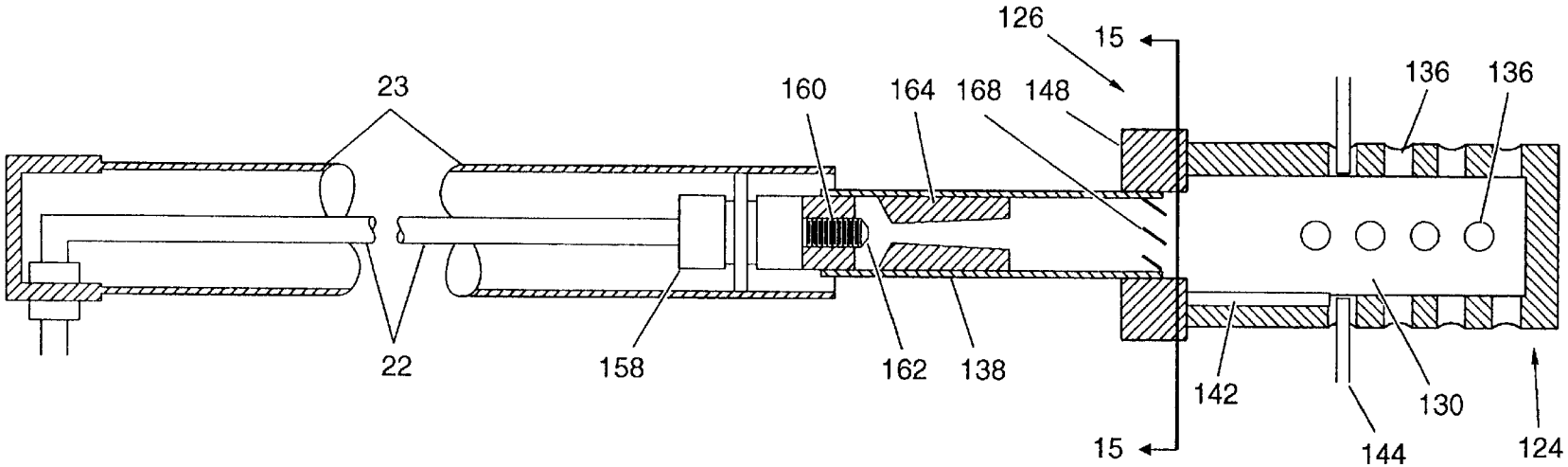
FIG. 14 shows a side view of a nozzle and pilot according to the embodiment of the invention shown in FIG. 10.
Figure 16:
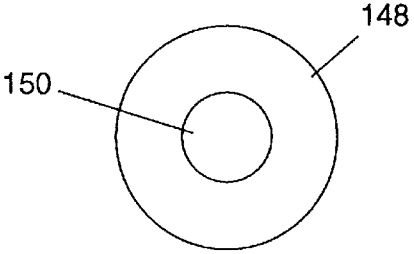
FIG. 16 shows a bottom view of the base plate of the frame of FIG. 11.

A further embodiment of the invention is shown in FIGS. 10–15. The nozzle 124 shown in made of the same material as nozzle 24, but its end 134 is closed. The nozzle 124 is formed from a housing having an encircling wall 128 defining an interior cavity 130 and is preferably cylindrical. One end 132 of the nozzle is open and one end is closed by an end wall 134. The encircling wall 128 and end wall 134 are each ¾" thick. The nozzle 124 shown here is 7" long. A plurality of openings 136 are formed circumferentially around the encircling wall 128 and extend radially through the encircling wall 128. As shown in FIG. 14, the gas supply line 22 supplies gas into the interior cavity 130 of the nozzle 124 through a tube 138 forming part of cage 126 confining the nozzle 124. The tube 138 and gas line 22 together form a gas supply conduit leading into the interior cavity 130 of the nozzle 124.

Figure 10:
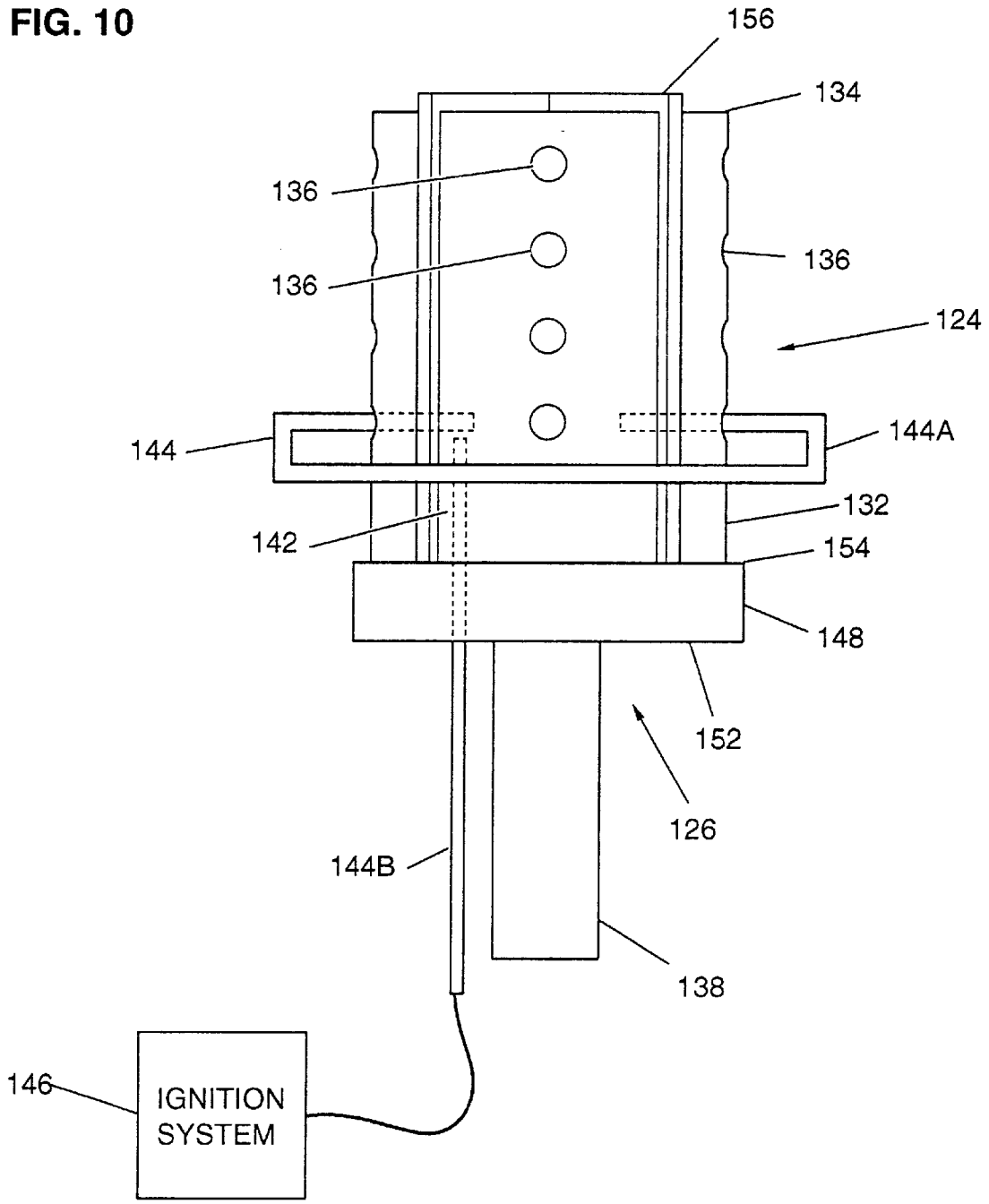
FIG. 10 shows a side view of a further embodiment of a nozzle according to the invention enclosed in a frame.
Figure 12:
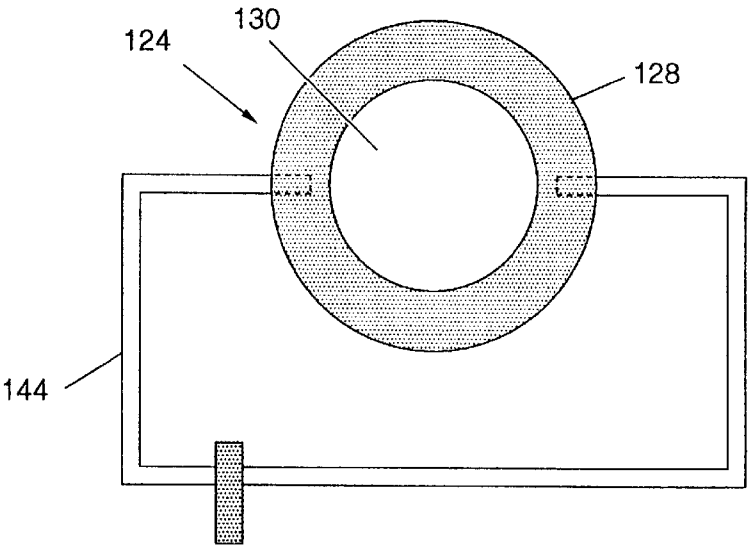
FIG. 12 shows a bottom view of a nozzle with an electrode according to the embodiment of the invention shown in FIG. 10.
Figure 11:
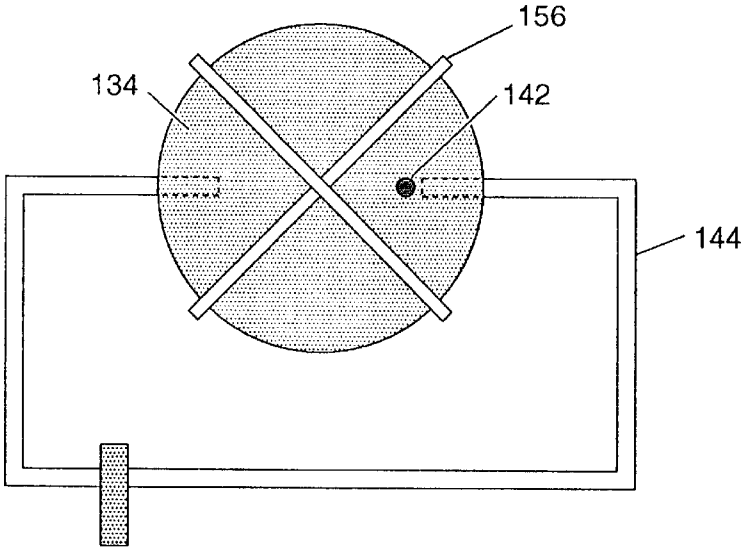
FIG. 11 shows a top view of a nozzle and frame with an electrode according to the embodiment of the invention shown in FIG. 10.
Figure 13:
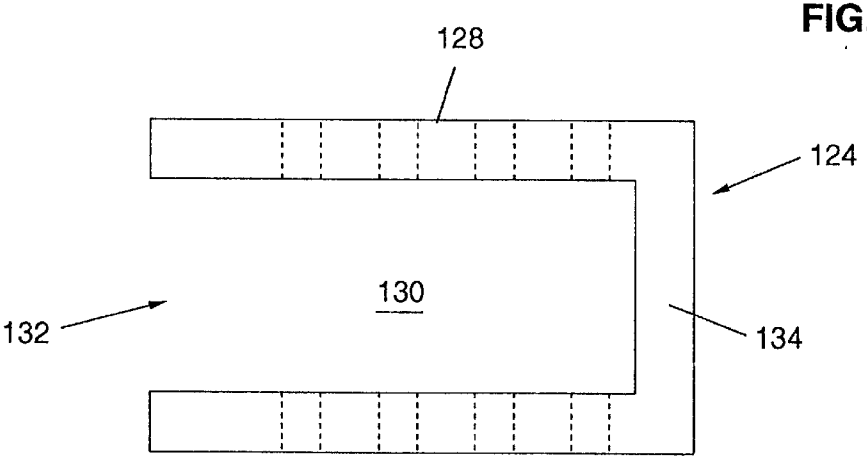
FIG. 13 shows a longitudinal section through a nozzle according to the embodiment of the invention shown in FIG. 10.

Referring in particular to FIGS. 10 and 11, a first electrode 142 extends into and is located within the interior cavity 130 of the nozzle 124. A second electrode 144 extends into the interior cavity 130 of the nozzle 124 through one of the openings 136. The first, interior electrode 142 is preferably grounded, and attached to the cage 126, which itself is electrically connected to the conduit 23, so that the majority of the components of the pilot are grounded. The second electrode 144 is preferably hot and connected to a source of electrical power such as ignition system 146, several of which are known in the art, as for example the one described in U.S. Pat. No. 5,291,367 on Mar. 1, 1994. Since the cage 126 is preferably stainless steel and connected to the supporting structure (see FIGS. 1 and 2) for the pilot, the hot electrode 144 cannot touch the frame and therefore is formed of a C-shaped segment rye having two ends, each of which is inserted through one of the holes 136. The advantage of two hot ends for the C-shaped electrode **144*a* is that several grounded electrodes 142 may be provided, spaced around the inside of the cavity 130, so that no matter which hole 136 the ends of the C-shaped section 144*a* are inserted through, there will be a nearby grounded electrode for a spark to jump across and ignite gas flowing into the nozzle. Current for the hot electrode is provided through section 144*b* of the electrode 144 (FIG. 2) which connects to the section 144*a* at welded cross-over 148. The section 144*b* of the electrode 144 is supported on electrically insulated supports (not shown, but see FIGS. 1 and 2 for a similar construction) extending from the conduit 23**. The hot and grounded electrodes could conceivably be reversed, with appropriate insulators for the hot electrode, but it is preferable that the hot electrode be on the outside.

The cage 126 enclosing the nozzle 124 is preferably formed from a circular base plate 148 having a central aperture 150. The tube 138 extends into the aperture 150 from side 152 of the base plate 148 and is fixed to the base plate 148 as by welding. A pair of crossed U-shaped retainers 156 extend from side 154 of base plate 148 and enclose the nozzle 124. More than a pair of retainers 156 may be used distributed around and extending from the base plate 148 in like manner.

Figure 15:
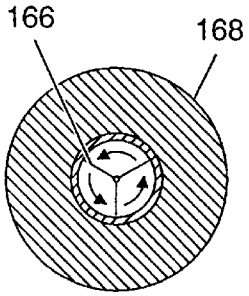
FIG. 15 shows an enlarged section along the line 15—15 of FIG. 14.

Referring to FIGS. 14 and 15, the manner of gas delivery to the nozzle 124 is shown. A supply line 22 is encased within the conduit 23. The supply line 22 leads out to a source of natural gas in conventional manner. The gas supply line 22 is secured within the conduit 23 by a conventional high pressure tubing fitting 158 braced across the end of the conduit 23. A nipple 160 is threaded into the tubing fitting 158, with the tip 162 of the nipple 160 terminating at one end of a venturi tube 164. The tube 138 of the cage 126 is fastened to one end of the tubing fitting 158. The nipple 160 extends into one end of the tube 138 and the venturi tube 164 is fastened across the interior of the tube 138. The other end of the tube 138 includes a mixer 166 formed of three pie-shaped cups 168 which are angled, as in the flights of a spiral, to impart a rotational movement to fluid moving from the tube 138 into the nozzle 124.

The nozzle and pilot thus described operates as follows. The pilot is used to maintain the flare in the top of the flare stack and it is important to keep the pilot light burning. Gas passing through gas line 22 is mixed with air in the tube 22 and mixer 66 or 166 and enters the interior cavity 45 or 30 of nozzle 24 or 124. An ignition current is supplied periodically as needed by the ignition system to the hot electrode 40 or 144. A thermocouple in the nozzle may be used to determine when ignition current needs to be supplied to the electrodes. Sparks passing between electrodes 40 and 41 or electrodes 142 and 144 adjacent one of the openings 42 in the case of electrodes 40 and 41 and 128 in the case of electrodes 142 and 144 keep the gas burning in the nozzle 24 or 124. The constriction of opening 42 of nozzle 24 or the closure of closed end 134 of the nozzle 124 helps prevent the pilot from going out. The size of opening 42 may be adjusted to allow flame to enter the cavity 45, and maintain a flame burning on the flame stabilizer 66, but to prevent downdrafts from extinguishing the flame such as by overcoming the pressure of the gas supply to the nozzle. Thus, the openings around the nozzle should be sufficiently wide in relation to the opening 42 that downdrafts through the opening 42 may be exhausted through the encircling side wall of the nozzle. Having the spark gap at the opening 42 is believed preferable to the design shown in FIGS. 10–15 since in the case of the design of FIGS. 10–15 sparks tend to jump to the ceramic rather than ignite the gas. The openings in the side wall of the nozzle allow wind to pass through the nozzle without extinguishing the flame on the flame stabilizer. The thermocouple can be used to set when ignition needs to be generated, and if the pilot will not light, as indicated by the thermocouple, it may be necessary to shut off the source of the gas being flared (as for example an oil processing plant).

A person skilled in the art could make immaterial modifications to the invention described and claimed in this patent without departing from the essence of the invention.

The embodiments of the invention in which an exclusive property or privilege is claimed are defined as follows:

1. A pilot being supported by a flare stack which includes a frame assembly, the pilot comprising a nozzle, conduit means for supplying gas to the nozzle, an igniter being located adjacent an outlet of the nozzle for igniting the supplied gas, and the frame assembly supporting the igniter, the nozzle and the conduit means on the flare stack;

wherein the conduit means comprises:

a conduit having opposed first and second ends;

the nozzle being secured to the first end of the conduit remote from the second end of the conduit to receive the supplied gas;

a venturi tube is secured between the conduit and the nozzle at a position such that the venturi tube draws gas from inside the conduit;

a gas supply line encased within the conduit from the second end to the first end of the conduit, and secured at the first end of the conduit by a tubing fitting; and a nipple secured to the tubing fitting and terminating at one end of the venturi tube.

2. The pilot of claim 1 in which the nozzle has a base, with an opening in the base and a tube extending from the opening, the venturi tube being secured within the tube.

3. A pilot being supported by a flare stack which includes a frame assembly, the pilot comprising a nozzle, conduit means for supplying gas to the nozzle, an igniter being located adjacent an outlet of the nozzle for igniting the supplied gas, and the frame assembly supporting the igniter, the nozzle and the conduit means on the flare stack; wherein the conduit means comprises;

a conduit having opposed first and second ends;

the nozzle being secured to the first end of the conduit remote from the second end of the conduit to receive the supplied gas;

a venturi tube secured between the conduit and the nozzle;

a gas supply line encased within the conduit from the second end to the first end of the conduit, and secured at the first end of the conduit by a tubing fitting;

a nipple secured to the tubing fitting and terminating at one end of the venturi tube; and a rotary flame stabilizer positioned at the base of the nozzle.

4. In a pilot of a flare stack, wherein the pilot comprises a nozzle, conduit means for supplying gas to the nozzle, an igniter being located adjacent an outlet of the nozzle for igniting the supplied gas, and a frame assembly supporting the igniter, the nozzle and the conduit means on the flare stack;

the improvement to the conduit means comprising:

a conduit having first and second ends;

the nozzle being secured to the first end of the conduit;

a venturi tube secured to the first end of the conduit adjacent the nozzle at a position such that the venturi tube draws gas from inside the conduit;

a gas supply line encased within the conduit from the second end to the first end of the conduit, and secured at the first end of the conduit by a tubing fitting; and a nipple secured to the tubing fitting; and a nipple secured to the tubing fitting and terminating at one end of the venturi tube.

5. The pilot of claim 4 in which the nozzle has a base, with an opening in the base and a tube extending from the opening, the venturi tube being secured within the tube.

6. The pilot of claim 4 further comprising a rotary flame stabilizer positioned at the base of the nozzle.

* * * * *